United States Patent [19]

Muzik

[11] 4,257,300

[45] Mar. 24, 1981

[54] APPARATUS FOR DEFACING PAPER MONEY AND SIMILAR SECURITIES

[75] Inventor: Vladimir Muzik, Nepomuk, Czechoslovakia

[73] Assignee: Statni banka ceskoslovenska, Prague, Czechoslovakia

[21] Appl. No.: 938,949

[22] Filed: Sep. 1, 1978

[30] Foreign Application Priority Data

Sep. 1, 1977 [CS] Czechoslovakia ..... 5703/77

[51] Int. Cl.[3] ..... B26F 1/14

[52] U.S. Cl. ..... 83/620; 83/146; 83/687; 83/689; 83/698

[58] Field of Search ..... 83/133, 146, 620, 622, 83/685-691, 698

[56] References Cited

U.S. PATENT DOCUMENTS

| | | | |
|---|---|---|---|
| 155,340 | 9/1874 | Sloper | 83/146 |
| 173,062 | 2/1876 | Robertson et al. | 83/698 X |
| 848,869 | 4/1907 | Upton | 83/689 X |
| 1,009,396 | 11/1911 | Fahrman | 83/620 |
| 2,093,202 | 9/1937 | Maynes | 83/689 X |
| 3,234,840 | 2/1966 | Smeets | 83/698 X |
| 3,320,843 | 5/1967 | Schott, Jr. | 83/689 X |
| 3,608,413 | 9/1971 | Borello | 83/687 X |
| 3,656,394 | 4/1972 | McCutcheon | 83/689 |
| 4,077,288 | 3/1978 | Holland | 83/687 X |

*Primary Examiner*—J. M. Meister

[57] ABSTRACT

There is disclosed an apparatus for punching packages of paper money and other securities for defacing them, the apparatus preventing the sticking together of individual sheets of said packages in order to permit a subsequent mechanical counting of the punched sheets of the package.

2 Claims, 8 Drawing Figures

APPARATUS FOR DEFACING PAPER MONEY AND SIMILAR SECURITIES

BACKGROUND OF THE INVENTION

This invention relates to an apparatus for defacing paper money and other securities by punching.

Different arrangements with one or two manually operated punching tools are actually presently used for defacing paper money. There are punching devices based on the principle of screw presses. Arrangements are also used which are based on the principle of boring appliances wherein a rotating cutting tool cuts an opening of predetermined diameter in a package of paper money, such apparatus employing a manually generated axial thrust imposed upon the cutting tool.

Paper money is punched to deface it in packages of a predetermined number of sheets; such number has to be checked by counting the money both prior to and after it has been defaced.

Due to the rotary cutting movement of the tool, arrangements based on the principle of boring do not allow a constant pressure to be imposed upon the tool, as the tool, when it penetrates into the paper package, digs in and tears out parts of individual sheets of paper or of a number of such sheets. Since synthetic resins are added to the paper mass in the manufacture of paper money, the cutting tool quickly becomes dull and is subsequently impaired by heat generated by friction. Another drawback of arrangements based on this principle is that for the same reasons a rotating head with a number of cutting tools cannot be used. With both arrangements based on the principle of punching or cutting tools, the punched or cut openings in the package are located irregularly over the surface of the paper money. Due to the character of the punching operation performed on the package, which results in a sticking together of individual sheets along the whole circumference of the punched openings or in the tearing off of borders of the openings and the mutual wedging together of individual sheets, it is impossible to perform the counting of the punched sheets of the package mechanically. The entire process of defacing paper money is therefore carried out manually. This requires a substantial physical stress for the manually operated arrangements for the punching of packages, and also requires much time for the proper punching and the subsequent counting of the punched sheets in a package.

A condition for the mechanization of operations in connection with the defacing of paper money in packages is that the holes or openings in the sheets should always be located at the same place on their surfaces without any deviations. Other conditions are that these openings should be of the same dimensions, and that the individual sheets should not stick together at the circumferences of the punched openings, but should be easily separated by turning over the punched sheets of paper money.

SUMMARY OF THE INVENTION

It is an object of the present invention to provide an arrangement for defacing paper money and similar securities which is able to cut clean holes in a package of sheets and which afterwards allows the number of cut sheets to be counted mechanically.

The arrangement or apparatus in accordance with this invention comprises a frame, a platen mounted for reciprocation relative to the frame, and a fixed partition wall fixedly mounted on the frame confronting the platen. The platen is reciprocated by suitable means, such as a reversely driven screw and a nut thereon affixed to the platen. A plurality of male dies or punch tools are distributed over the area of the platen, the punch tools being retained on the platen by three stacked plates: a supporting plate abutting the platen, an intermediate safety plate, and a forward or return stroke plate. The safety plate has an opening therein receiving the rear flanged end of the respective punch tool. The return stroke plate has a keyhole opening therein, the larger portion of the keyhole opening freely receiving the flanged end of the punch tool therethrough, the smaller portion of the keyhole opening receiving an annularly grooved portion of reduced diameter of the punch tool forwardly of the flange thereon. The three stacked plates, with the punch tools in place, are retained upon the platen and secured to each other by means such as screws.

Each of the punch tools is of cylindrical shape, and at its forward cutting end has twin diametrically opposed cutting edges of parabolic shape. Such cutting edges are separated by a channel with a semicircular bottom, the ratio of the depth of the channel and of the diameter of the cylindrical twin edge punch being about 0.54:1. The ratio of the radius of the bottom of such channel and of the diameter of the cylindrical punch is about 0.3:1. In order to secure the punch tools in a desired angular position about its longitudinal axis, the flange on the rear end of the tool is provided with a radial slot, such slot receiving a radially disposed key extending inwardly from the opening receiving the flanged rear end of the tool in the intermediate or safety plate.

Advantages obtained by use of the apparatus of the invention include the fact that it is possible to deface a package of paper money under predetermined conditions, i.e. by punching with a predetermined desired number of openings having a predetermined distribution over the surface of the sheets, such conditions being maintained with all of the sheets of the package, and that it is possible subsequently to count the sheets of the punched package mechanically on devices designed for this purpose without the necessity of adjusting anything on the packages either mechanically or manually. Such advantages result from the novel design of the punches.

Other substantial advantages are the improved service life of the tools, i.e. of the punches, which is also due to their design and to the design of the entire arrangement. The productivity of the arrangement according to the present invention is equally advantageous; such arrangement has a productivity which is five times that of previously known arrangements, while eliminating the stress of manual work.

It is to be understood that the size of the apparatus depends upon the size of the paper money or securities to be defaced. Thus the size of the apparatus made be made to correspond to actual required banking services. Due to its design, the arrangement operates with a noise level well below the legal limit. The operators of the arrangement need not possess a particularly high level of technical skill, the skill to operate the arrangement being of a level no greater than that required for operating a number of currently used appliances.

DESCRIPTION OF DRAWINGS

An exemplary embodiment of an arrangement for defacing paper money in accordance with the invention is illustrated in the attached drawings, wherein.

DESCRIPTION OF PREFERRED EMBODIMENT

Figure 1:
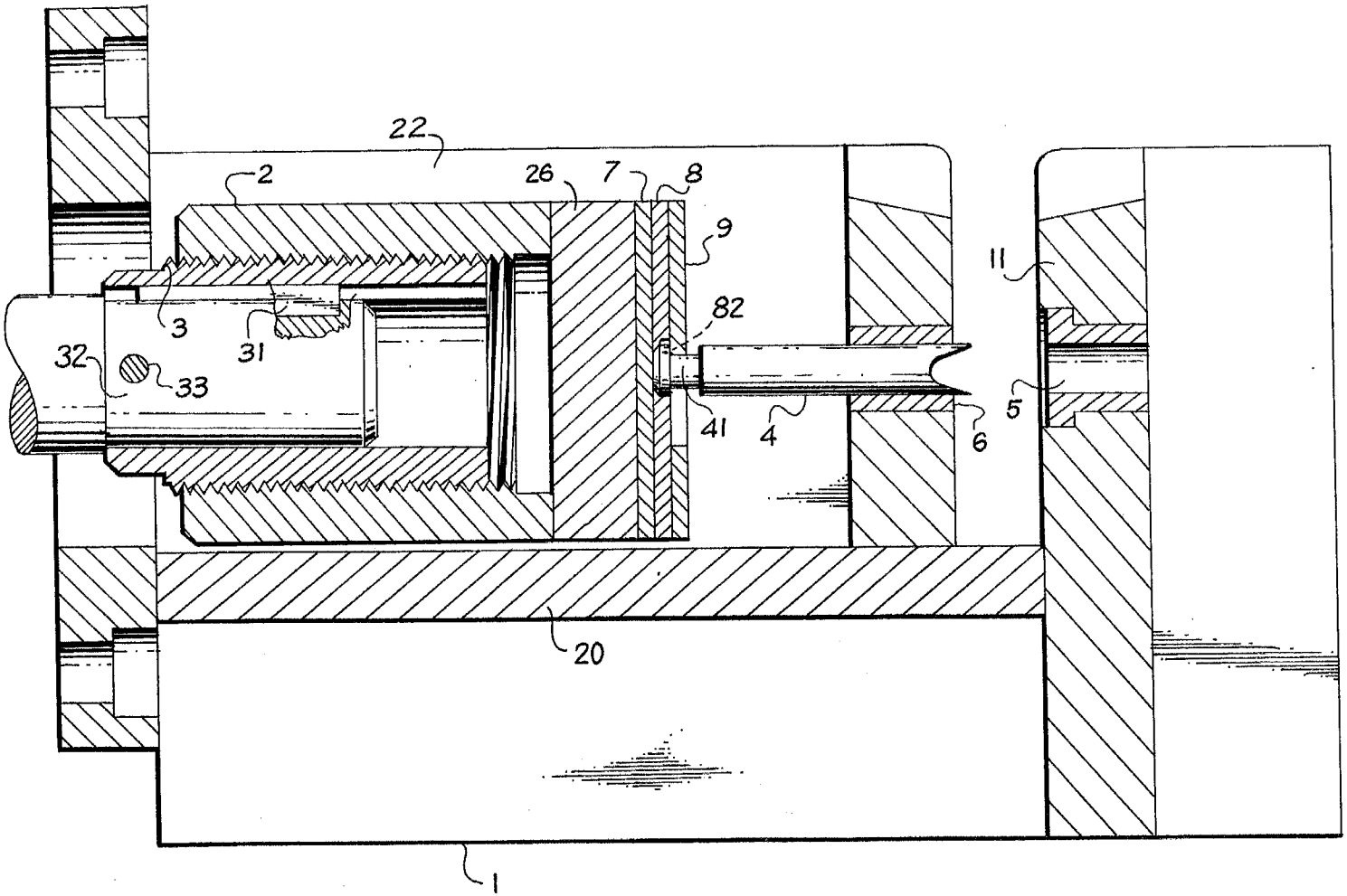
FIG. 1 is a view in longitudinal vertical section through the apparatus, certain of the parts being shown in elevation, the section being taken along the line 1—1 of FIG. 2.
Figure 2:
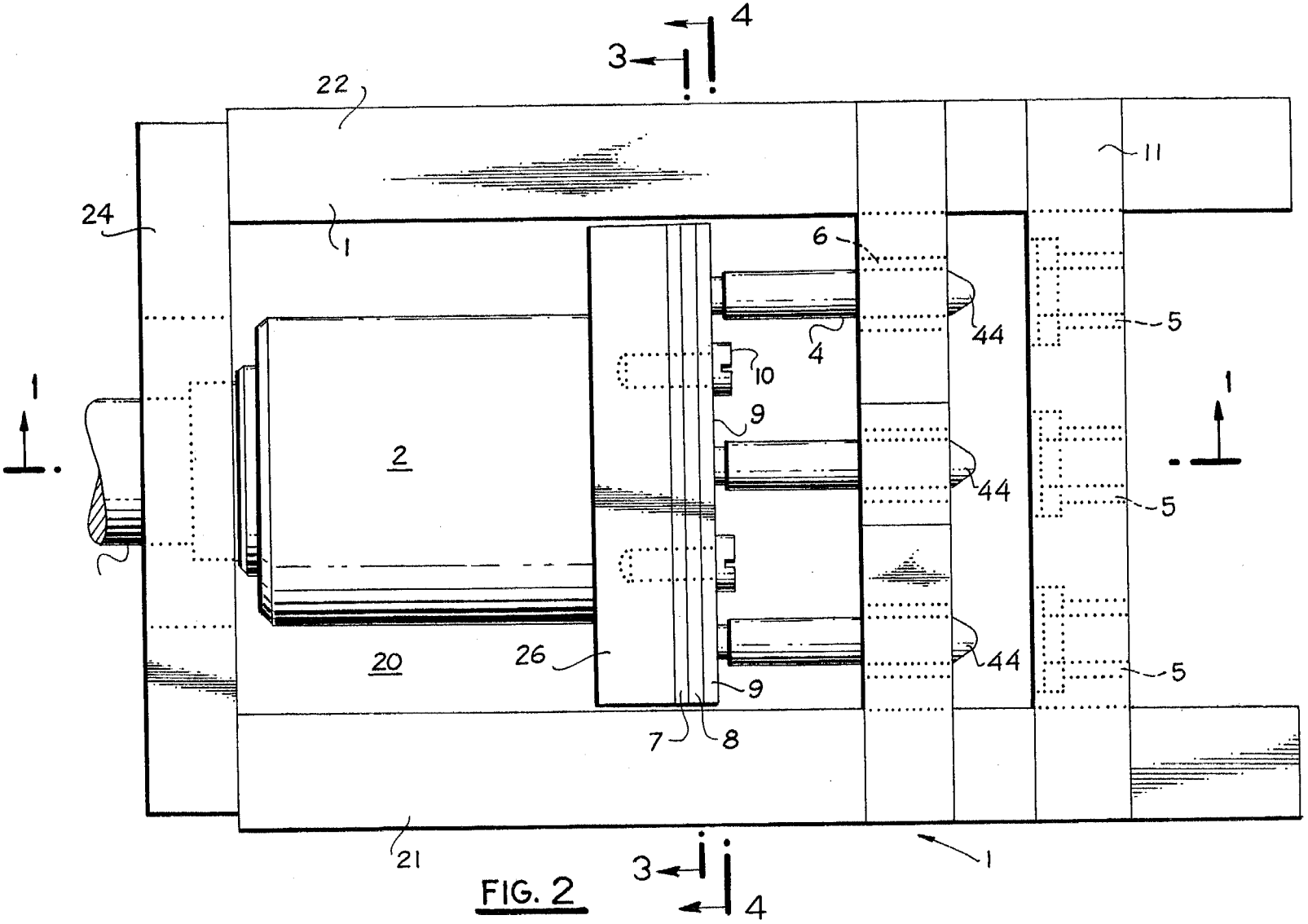
FIG. 2 is a view in plan of the apparatus of FIG. 1.

Turning first to FIGS. 1 and 2, the apparatus arrangement according to the invention comprises a horizontally elongated frame 1 having a bottom member 20 to the right hand end of which there is affixed a vertically extending partition wall member 11. As shown in FIG. 2, the frame has two spaced parallel horizontal side frame members 21 and 22 which are secured at the right hand end to the wall member 11 and are joined at their left ends by a vertical plate member 24. A platen 26 is mounted for horizontal reciprocation on the frame above the lower frame member 20 and between the side frame members 21 and 22. Platen 26 is reciprocated by the reverse rotation of an externally threaded sleeve 3 which is threadedly engaged within an outer, interiorly threaded sleeve 2 which is affixed to the platen 26. A driving shaft 32, which is secured to the sleeve 3 by a cross bolt or pin 33 and a longitudinally extending key 31, is selectively driven in reverse directions by a prime mover such as a reversible electric motor (not shown) which may be mounted upon the member 24 of the frame.

Figure 3:
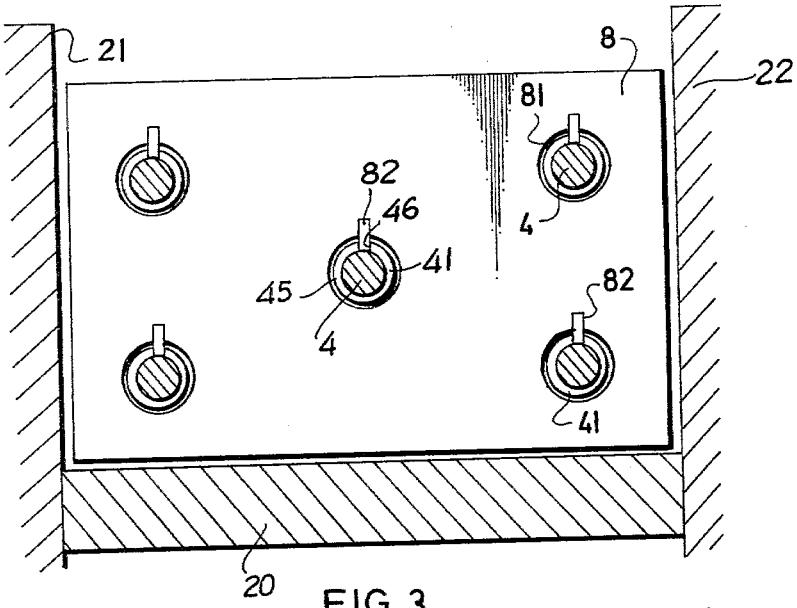
FIG. 3 is a view in vertical transverse section through the apparatus, a section being taken along the line 3—3 of FIG. 2.
Figure 4:
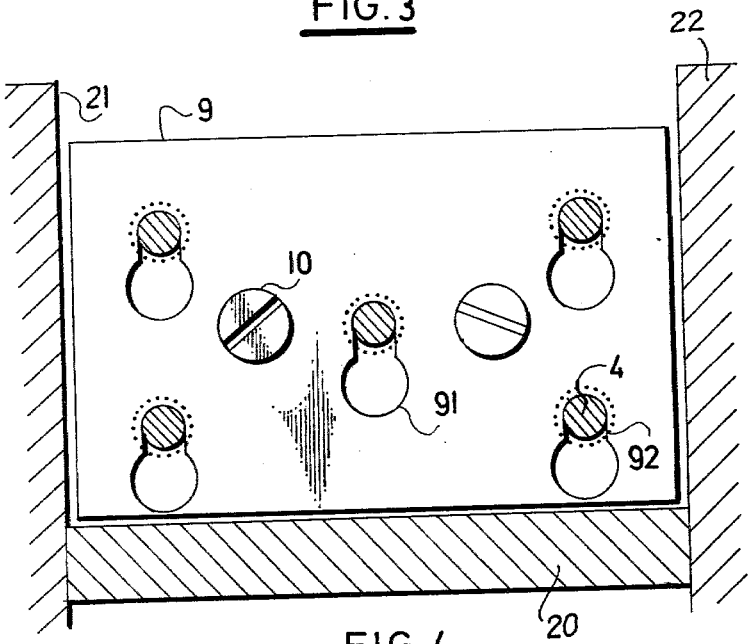
FIG. 4 is a view in transverse vertical section through the apparatus, the section being taken along the line 4—4 of FIG. 2.

A plurality of male or punch tools 4 are mounted upon the right hand or forward face of the platen 26, as shown. As shown in FIGS. 3 and 4 tools are distributed over the area of the platen. Punches 4 extend through and are guided by respective guiding sleeves 6 on an intermediate cross member of the frame, the forward ends of the punches being selectively received within dies 5 mounted on the partition wall member 11.

The left hand or rear ends of the punches 2 are secured to the platen 26 in the following manner. A supporting plate 7 is mounted upon the forward face of the platen. Abutting the plate 7 is an intermediate or safety plate 8, and abutting the plate 8 is a return stroke plate 9. When the parts are in the assembled condition thereof shown in FIGS. 1 and 2, the plates 7, 8, and 9 are held in stacked relationship and fastened to the platen 26 by a plurality of machine screws 10.

Figure 6:
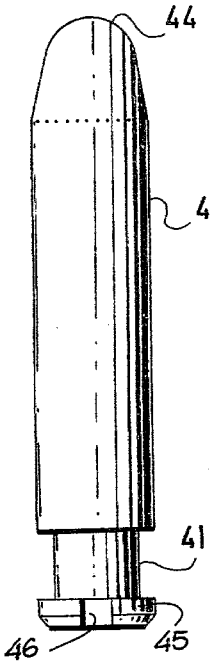
FIG. 6 is a view in elevation of a tool punch employed in the apparatus of the invention.
Figure 8:
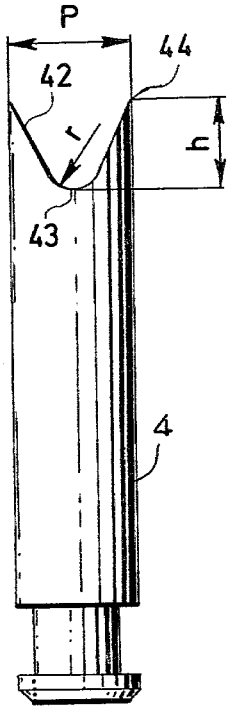
FIG. 8 is a view in elevation of the punch shown in FIG. 6, the view in FIG. 8 being taken in a direction displaced 90° from that of FIG. 6.
Figure 5:
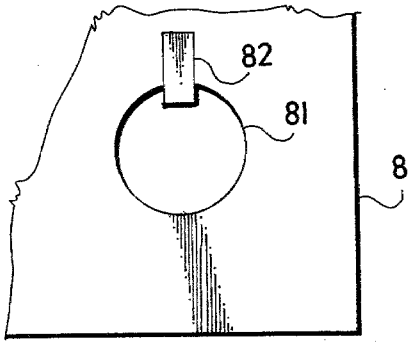
FIG. 5 is a fragmentary view in plan of the safety plate in the vicinity of a safety opening therein.
Figure 7:
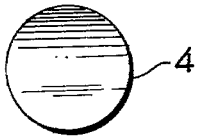
FIG. 7 is a view in plan of the punch of FIG. 6.

As shown in FIGS. 6 and 8, each punch 4, which is of circular cylindrical cross section, has a forward cutting end 44, a flange or collar 45 on its rear end, and an annular groove 41 disposed forwardly of the flange 45. In order to ensure the correct orientation of the punches 4 in the means which holds them upon the platen 26, the flange on the rear end thereof is provided with a radial slot 46 which receives a radial key 82 provided at each opening 81 in the safety plate 8. The return stroke plate 8, which is shown most clearly in FIG. 4, is provided with a plurality of keyhole openings 91, the keyhole openings in the larger portion thereof at least slightly exceeding in diameter the diameter of the flange 45 on the punches, and in the narrower portion 92 thereof at least slightly exceeding in diameter the groove 41 on the rear end of the punch.

Punches 4 are removed from the platen by moving the platen to the left in FIGS. 1 and 2, and thereafter removing the screws 10 from the platen 26 and the stacked plates 7, 8, and 9. This permits the return stroke plate 9 to be moved upwardly in FIG. 4 so that the flange 45 on the punches 4 may then pass freely through the larger portion of the keyhole passages 91 in the plate 9. Punches are mounted upon the platen 26 by a procedure which is the reverse of that described immediately above.

In the embodiment of the punch 4 shown in FIG. 8, the circular cylindrical punches have a diameter P equal to 13 mm, a depth h of the channel 42 between the diametrically opposed cutting edges of the punch equal to 7.02 mm, and a radius r of the bottom 43 of the channel 42 equal to 4.2 mm. It is to be understood that such values are exemplary only. It is also to be understood that if desired each of the punches 4 may be provided with two diametrically opposed radial slots 46 in the flange 45, since the two opposed cutting edges on the foward end 44 of each punch are symmetrically disposed with respect to the diameter of the punch.

In the operation of the disposed apparatus, packages of paper money are inserted into the apparatus immediately to the rear of the partition wall member 11. The prime mover for driving the shaft 32 is then started and run in to drive the platen 26 forwardly, so that the forward cutting edges of the punches 4 first engage the rear most sheet of the stack of paper money and then travel progressively through such stack. In the disclosed arrangement, five punches 4 are employed, and thus the packages of paper money are perforated in five locations. After the platen 26 has traveled forwardly for a distance sufficient to cause the punches 4 to perforate all of the paper money in the stack, the prime mover is stopped and then reversed in direction, thereby enabling the perforated stack of money to be removed from the apparatus, and the platen and punches to be moved to their original position, after which the prime mover is stopped and the apparatus is ready for a new operating cycle.

The apparatus of the invention can be utilized for similar purposes for different securities, coupons, bonds, and the like, and can be adjusted for a chosen purpose without departing from the scope of the invention.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. Apparatus for defacing paper money and similar securities, comprising a frame, a platen mounted on the frame and reciprocable with respect thereto, a transverse partition wall member on the frame forwardly of the platen and extending normal to the direction of reciprocation of the platen for cooperation therewith, means for reciprocating the platen, at least one cylindrical punch tool secured to the platen and extending in the direction of reciprocation of the platen, a female die secured on the abutment partition wall member in alignment with the punch tool, means securing the punch tool to the platen, the forward active end of the punch tool being provided with a twin cutting edge of parabolic shape, both of said cutting edges of the tool being separated by a channel with a semicircular bottom, the ratio of the axial depth of the channel and of the diameter of the punch being substantially 0.54 to 1, and the ratio of the radius of the bottom part of the channel and of the diameter of the cylindrical punch being substantially 0.3 to 1, and comprising a supporting plate, a safety plate, and a return stroke plate disposed in stacked relationship and secured to the platen in that order with the supporting plate abutting the platen, the return stroke plate being provided with a number of keyhole slots, each of the punch tools being provided on the end thereof adjacent the platen with a flange and an annular groove forwardly of the flange, when operatively mounted upon the platen each of the punch tools having the flanged rear end thereof received in an aperture in the safety plate and the grooved portion of the punch tool received within the narrower portion of the keyhole slot in the return stroke plate, and comprising means for securing the supporting plate, the safety plate, and the return stroke plate together and to the platen.

2. Apparatus in accordance with claim 1, comprising a radially extending slot in the flange on the rear end of the punch tool, and a radially extending key on the safety plate received in the radial slot in the flange on the rear end of the punch tool when the punch tool is operatively mounted upon the platen.

* * * * *